US007963390B2

(12) United States Patent
Yamamoto et al.

(10) Patent No.: US 7,963,390 B2
(45) Date of Patent: Jun. 21, 2011

(54) CONTACT LENS STORAGE CASE

(75) Inventors: Tatsuo Yamamoto, Okayama (JP); Yasuo Kurihara, Aichi (JP); Mutsumi Nakano, Aichi (JP); Takayoshi Kaizuka, Tokyo (JP)

(73) Assignees: Sinanen Zeomic Co., Ltd., Nagoya-shi, Aichi-ken (JP); K.K. Suntech, Nagoya-shi, Aichi-ken (JP); Daisho Sangyo Co., Ltd., Tokyo (JP); Tatsuo Yamamoto, Akaiwa-shi, Okayama-ken (JP)

( * ) Notice: Subject to any disclaimer, the term of this patent is extended or adjusted under 35 U.S.C. 154(b) by 0 days.

(21) Appl. No.: 12/636,012

(22) Filed: Dec. 11, 2009

(65) Prior Publication Data

US 2011/0048973 A1 Mar. 3, 2011

(30) Foreign Application Priority Data

Aug. 26, 2009 (JP) ..... 2009-195964

(51) Int. Cl.
*A45C 11/04* (2006.01)

(52) U.S. Cl. ..... 206/5.1; 134/901; 424/429

(58) Field of Classification Search ..... None
See application file for complete search history.

(56) References Cited

U.S. PATENT DOCUMENTS

| | | | | |
|---|---|---|---|---|
| 5,382,599 | A | 1/1995 | Rupp et al. | |
| 6,318,549 | B1 * | 11/2001 | Bougamont et al. | 206/5.1 |
| 6,679,373 | B1 * | 1/2004 | Clevenger | 206/5.1 |
| 7,661,383 | B2 * | 2/2010 | Song | 116/308 |
| 2002/0069896 | A1 * | 6/2002 | Pankow | 134/6 |
| 2003/0044447 | A1 * | 3/2003 | Zanini et al. | 424/429 |
| 2008/0029408 | A1 * | 2/2008 | Andersen | 206/5.1 |

FOREIGN PATENT DOCUMENTS

JP 2005-177515 A 7/2005

* cited by examiner

*Primary Examiner* — Jacob K Ackun, Jr.

(74) *Attorney, Agent, or Firm* — Holtz Holtz Goodman & Chick PC

(57) ABSTRACT

A contact lens storage case comprising a case body including a pair of chambers for containing contact lenses therein, and a pair of lids for closing and opening the chambers, wherein inner faces of the chambers of the case body are formed by a synthetic resin including a silver based inorganic antimicrobic agent comprising a silver based compound carried on an inorganic carrier selected from the group consisting of a zeolite, a water soluble glass, zirconium phosphate, silica gel and activated charcoal. The contact lens storage case inhibits acanthamoeba.

3 Claims, 1 Drawing Sheet

CONTACT LENS STORAGE CASE

FIELD OF THE INVENTION

The present invention relates generally to a contact lens storage case containing silver based the inorganic antimicrobial agent for inhibiting acanthamoeba keratitis due to the putting on and off of the contact lens.

BACKGROUND OF THE INVENTION

It is well known in the art that there are many different types of the contact lens including a soft contact lens, rigid contact lens, and color contact lens for fashion. Now, it is reported in Japan that almost 16 million people wear contact lenses. Further, the prescribed wearing period of the contacts may be ranged from a day to a few years.

It is reported in many European and American countries from about 1974 that the corneal infection due to acanthamoeba had been occurred among contact lens wearers, and now the mechanism of acanthamoeba keratitis is evident.

Acanthamoeba is a genus of amoebae, one of the most common protozoa in soil, and also frequently found in fresh water and in river, lake, and pound or other habitats. Acanthamoeba ingests microorganisms as nutrient and proliferated. Upon number of microorganisms are reduced, it takes a form of cyst to halt the proliferation. Further getting worse the environment, it will die.

The contact lens of soft type is made of a material higher in its ability to hold water so that the lenses are apt to be contaminated by the deposition and colonization of acanthamoeba.

In this connection, it is believed that the risk factors associated with acanthamoeba keratitis are higher in the soft contact lens wearer.

The majority of the soft contact lens wearers are prescribed some type of frequent replacement schedule. With a true daily wear disposable schedule, a brand new pair of lenses is used each day. However, actually, they may be worn continuously after the prescribed schedule had expired (for example 4 or 5 days or more).

After removed the contact lenses, they are immersed within tap water or multipurpose solution (referred herein below to as MPS) within the lens storage case. When it is intended to put them on, they are picked up from the case.

When the lenses are handled by fingers and hands contaminated by any bacteria or acanthamoeba, the surface of the lenses and the solution within the case may also be contaminated. In this connection, the lenses stored in the case will further be contaminated.

The infection has been associated with penetrating corneal trauma. The main cause of the infection is to wear the contaminated contact lenses. The basic countermeasures to be taken for preventing the infection are to handle the lens sterilely and appropriately.

Although the bacteria and acanthamoeba can easily be killed by thermal disinfection, the heat energy required for the disinfection will distort the lens to destroy the function thereof.

Organic bacteriocides such as alcoholic, halogenic, and phenolic bacteriocides or antimicrobial agents have toxicity to the cells of the eyes so that using such bacteriocidal additives in MPS may be problematic and cannot be put into practical use. Although the MPS including polyvalent cationic chelate has been proposed (see patent 1 listed hereinbelow), this MPS does not have sufficient effect for killing on acanthamoeba with the predetermined short period.

Today, we have no sovereign remedy against corneal infection due to acanthamoeba, and it is very difficult to treat it.

[patent 1] Japanese Laid Open Public Disclosure 2005-177515

DISCLOSURE OF THE INVENTION

Problem or Problems to be Solved by the Invention

It is the object of the present invention is to provide a contact lens storage case higher in its safety, and being able to inhibit the proliferation of acanthamoeba deposited on the contact lens, and thus to avoid the corneal infection due to acanthamoeba can be avoided.

The inventor of the present invention find that the concentration of silver content of the resinous material of the contact lens case is not less than 0.005 wt %, microorganism and acanthamoeba will be killed or lost their activity.

The Effect or Effects to be Obtained from the Invention

The silver based inorganic antimicrobial agent is higher in its safety, have broad antibiotic spectrum, have no drug resistance, and has a long lasing effectiveness.

The silver based inorganic antimicrobial agent can be produced by carrying silver based compounds on inorganic carriers.

Suitable inorganic carriers can be selected from the group comprising zeolite, water soluble glass, zirconium phosphate, silica gel, and activated charcoal or so. The silver based compounds to be carried can be produced by the combination of $AgNO_3$, $Ag_2O$, $AgClO_4$, $AgCH_3COO$, etc. However, these combinations of silver based inorganic antimicrobial agent are not intended to be exhaustive. Further, the amount of silver content is not limited to the above mentioned percentage.

Many goods such as cutting boards, fiber products such as closings, and miscellaneous goods including silver based inorganic antimicrobial agent are prevailed in the market places. Of course, the safety thereof had been ascertained.

The case of the present invention has a function to kill or make cyst the microorganisms and acanthamoeba included in the MPS in the case.

DETAILED DESCRIPTION OF THE INVENTION

The contact lens storage container of the present invention includes a case body 1, a pair of storage chambers 2, 3 provided in the upper part of the case body 1 for containing left and right contact lenses independently therein, and a pair of screw caps 4, 5 providing lids for removably closing each chamber.

Elements of the container such as body 1 and screw caps 4, 5 are all made of synthetic resin. The body 1 is formed by the resinous material containing silver based inorganic antimicrobial agent.

The caps 4, 5 may also be made of the material the same as that of the body.

The amount of the silver based inorganic antimicrobial agent to be added to the resinous material forming the body of the case is controlled to achieve the concentration of the silver content not less than 0.005 wt % with respect to the resin.

An experiment is carried out as mentioned below to certify whether sufficient acanthamoebacidal property can be derived from the amount of silver content specified above.

<Test 1>

Formed are experimental sample cases of polypropylene in which phosphoric antimicrobial agent including silver content in the concentration of 0.5 wt % is added in the concentration of 0.5 wt %, 1.0 wt %, 1.5 wt %, 2.0 wt %, 3.0 wt %, and 5.0 wt % respectively.

The silver content concentration in the resinous material of each sample is amounted to 0.0025 wt %, 0.005 wt %, 0.0075 wt %, 0.01 wt %, 0.015 wt %, and 0.025 wt % respectively.

At first the chambers of each case are filled with tap water of 4 ml, then *E. coli* (IF03972) solution of 0.1 ml controlled to $1.2\times10^6$/ml is added thereto, and at the same time the solution of acanthamoeba castellani (ATCC30011) of 0.1 ml controlled to $5.3\times10^4$/ml is also added, and thus obtained specimens are left under the condition of 25° C. for 6 hours. The culture medium to be employed can be obtained from Becton, Dickinson and Company as Difco•NB medium (nutrient Broth medium). Measured are the initial bacterial count and the bacterial count after 6 hours had expired.

The measurement of the number of acanthamoeba will be effected by adding 3% hydrogen peroxide of 5 ml to the solution and leave it for 30 minutes, and filtered thus obtained solution through membrane filter neutralized by natrium pyruvate. Then the filter is incubated in PYG (protease peptone, yeast extract, glucose) medium for 2 weeks. The presence of acanthamoeba is then observed through naked eyes and microscope.

TABLE 1

| amount of Ag (wt %) | bacterial count of of E. coil (/ml) | bacterial count of E. coil after 6 hours (/ml) | the presence of acanthamoeba |
|---|---|---|---|
| 0.0025 | $3\times10^4$ | $2.3\times10^4$ | detected (+) |
| 0.005 | $3\times10^4$ | $1.8\times10^2$ | detected (±) |
| 0.0075 | $3\times10^4$ | less then 10 | undetected |
| 0.01 | $3\times10^4$ | less then 10 | undetected |
| 0.015 | $3\times10^4$ | less then 10 | undetected |
| 0.025 | $3\times10^4$ | less then 10 | undetected |

As can be seen from the test results as listed on the table 1, when the amount of Ag included in the resinous material forming the case body 1 is above 0.005 wt %, substantially no acanthamoeba can be detected, and if it is above 0.0075 wt %, much better effect can be obtained.

<Test 2>

Sample cases are formed from polypropylene including antimicrobial agent containing silver zeolite in the amount of 0.25 wt %, 0.5 wt %, 0.75 wt %, 1.0 wt %, 2 wt %, 3 wt %, and 5 wt %. The concentration of Ag of each sample case is amounted respectively to 0.0025 wt %, 0.005 wt %, 0.0075 wt %, 0.01 wt %, 0.02 wt %, 0.03 wt %, and 0.05 wt %.

The chambers of each sample case are filled with the Rohto C Cube Soft one moist (name of the product) MPS available from Rohto Pharmaceutical Co., Ltd. of 4 ml, then *S. aureus* (IF 012732) solution of 0.1 ml controlled to $1.5\times10^6$/ml is added thereto, and at the same time the solution of acanthamoeba castellani (ATCC30011) of 0.1 ml controlled to $5.3\times10^4$/ml is also added, and thus obtained specimens are left under the condition of 25° C. for 6 hours. The culture medium to be employed for *S. aureus* can be obtained as Difco•NB medium (nutrient Broth medium). Measured are the initial bacterial count and the bacterial count after 6 hours had expired.

The measurement of the number of acanthamoeba will be effected by adding 3% hydrogen peroxide of 5 ml to the solution and leave it for 30 minutes, and filtered thus obtained solution through membrane filter neutralized by natrium pyruvate. Then the filter is incubated in PYG (protease peptone, yeast extract, glucose) medium for 2 weeks. The presence of acanthamoeba is then observed through naked eyes and microscope.

TABLE 2

| amount of (wt %) | Ag bacterial of *S. aureus* (/ml) | count of bacterial count of *s. aureus* after 6 hours (/ml) | the presence of acanthamoeba |
|---|---|---|---|
| 0.0025 | $3.8\times10^4$ | $3.2\times10^4$ | detected (+) |
| 0.05 | $3.8\times10^4$ | $5.8\times10^2$ | detected (±) |
| 0.0075 | $3.8\times10^4$ | less then 10 | undetected |
| 0.01 | $3.8\times10^4$ | less then 10 | undetected |
| 0.02 | $3.8\times10^4$ | less then 10 | undetected |
| 0.03 | $3.8\times10^4$ | less then 10 | undetected |
| 0.05 | $3.8\times10^4$ | less then 10 | undetected |

As can be seen from the test results as listed on the table 2, when the amount of Ag included in the resinous material forming the case body 1 is above 0.005 wt %, substantially no acanthamoeba can be detected, and if it is above 0.0075 wt %, much better effect can be obtained.

<Test 3>

The amount of Ag content to be eluted from sample cases of the same lot is measured by means of the atomic absorption spectrophotometer (Z-2310 of Hitachi). The sample cases are formed of resinous material including phosphoric antimicrobial agent containing Ag content in the concentration of 0.5 wt %. The measurement is effected in the condition mentioned hereinbelow.

The chambers of each case are filled with tap water of 4 ml and left it in 20° C. for 5 hours, and then replaced with new tap water. This procedure is repeated in 10 times. The concentration of eluted Ag in the 1st, 3rd, 5th, 7th, and 10th specimens are measured.

BRIEF DESCRIPTION OF THE DRAWINGS

Embodiments of the present invention will now be described more fully with reference to the accompanying drawings in which.

TABLE 3

| amount of Ag (wt %) | 1st specimen (ppb) | 3rd specimen (ppb) | 5th specimen (ppb) | 7th specimen (ppb) | 10th specimen (ppb) |
|---|---|---|---|---|---|
| 0.0025 | 0 | 0 | 1 | 0 | 1 |
| 0.005 | 15 | 14 | 15 | 17 | 18 |
| 0.0075 | 18 | 21 | 27 | 29 | 31 |
| 0.01 | 19 | 22 | 25 | 33 | 40 |
| 0.015 | 40 | 44 | 58 | 60 | 71 |
| 0.025 | 96 | 135 | 154 | 165 | 170 |

It can be appreciated the test results as listed on the table 3 that the sufficient amount of silver ion for preventing the proliferation of acanthamoeba can be eluted from the silver-based inorganic antimicrobial agent included in the resinous material of the lens case to the tap water contained in the chambers of the lens case when the amount of Ag content is not less than 0.005 wt %.

It can be seen from the experimental results obtained as outlined above that sufficient amount of silver ions are eluted from the silver based inorganic antimicrobic agent included in the case body 1 to the tap water or MPS contained in the storage chambers 2, 3, and thus eluted silver ions has enough effects to kill acanthamoeba deposited on the surface of the lenses or freed from the lenses.

Although the above mentioned experiments are made on the cases in which the silver based inorganic antimicrobic agent is blended over whole mass of the material of the case body, it is not necessary to do so. In other words, the silver based inorganic antimicrobic agent may be included only on the inner surface of the chamber 2, 3 i.e. the antimicrobic agent can only be included at least in a portion of the resin of the body on which the tap water or preservative solution such as MPS contacts.

Figure 1:
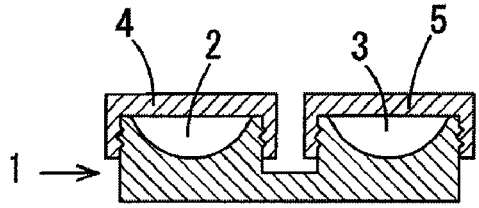
FIG. 1 is a cross-sectional view illustrating the contact lens storage case of an embodiment of the present invention.
Figure 2:
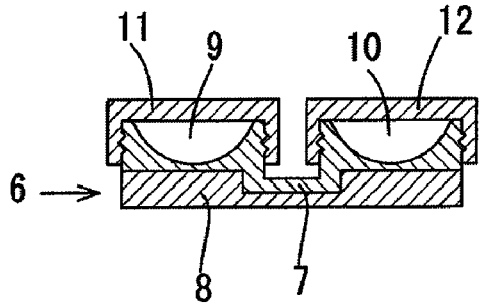
FIG. 2 is a cross-sectional view illustrating the contact lens storage case of another embodiment of the present invention.

To say concretely on the latter embodiment, the case body 6 may comprise upper and lower layers or formations 7 and 8 as shown in FIG. 2. In this construction the lower layer 8 does not include any special agents, and the silver based inorganic antimicrobic agent may only be included in the upper layer 7 forming a pair of chambers 9 and 10.

In such an embodiment, the total amount of the silver based inorganic antimicrobic agent can be reduced since only the upper layer 7 can include the agent.

If it is intended to provide caps 11 and 12 in which the material thereof can include the silver based inorganic antimicrobic agent, the caps may also be formed as two-layer structure in which only the layer to be contacted with the preserving liquid in the chamber is provided with the antimicrobic agent.

The case body and the caps may be of multi layered structure including two or more layered structures. Further, only the surfaces of the case body and the caps may include the silver based inorganic antimicrobic agent.

Figure 3:
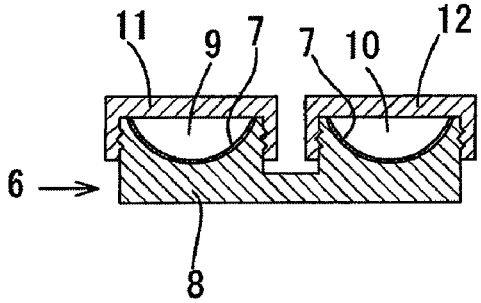
FIG. 3 is a cross-sectional view illustrating the contact lens storage case of yet another embodiment of the present invention.

The layer including silver based inorganic antimicrobic agent, i.e. the upper layer 7 in the above-mentioned embodiment, may be provided only on the inner surfaces of the chamber 9, 10 as shown in FIG. 3, or on the upper surface of the case body 6. In such cases, it is preferable to provide a sheet material of the thickness about 100 μm impregnated with the silver based inorganic antimicrobic agent and fuse or bond it on the lower layer 8.

In this embodiment the amount of the silver based inorganic antimicrobic agent to be utilized can be reduced substantially relative to that of the embodiment as shown in FIG. 2. The management of the material to be used can be made easily in the manufacture of the lens case. The upper layer 7 can be made replaceable. Thus, the amount of silver contents to be eluted into the tap water or MPS filling the chambers 9 and 10 can be maintained relatively high in spite of the fact that the amount of silver content eluted is reduced with time by replacing the depleted one with bland new one.

It is to be appreciated that the invention has been described hereinabove with reference to certain examples or embodiments of the invention but that various additions, deletions, alterations and modifications may be made to those examples and embodiments without departing from the intended sprit and scope of the invention. For example, any element or attribute of one embodiment or example may be incorporated into or used with another embodiment or example, unless to do so would render the embodiment or example unpatentable or unsuited for its intended use. All reasonable additions, deletions, modifications and alterations are to be considered equivalents of the described examples and embodiments and are to be included within the scope of the following claims.

What is claimed is:

1. A contact lens storage case comprising:

a case body including a pair of chambers for containing contact lenses therein, and a pair of lids for closing and opening the chambers, wherein inner faces of the chambers of the case body are formed by a synthetic resin including a silver based inorganic antimicrobic agent comprising a silver based compound carried on an inorganic carrier selected from the group consisting of a zeolite, a water soluble glass, zirconium phosphate, silica gel and activated charcoal.

2. The contact lens storage case claimed in claim 1, in which acanthamoeba is inhibited, and the amount of the silver content of the synthetic resin is not less than 0.005 wt %.

3. The contact lens storage case claimed in claim 1, in which acanthamoeba is inhibited, and the amount of the silver content of the synthetic resin is not less than 0.0075 wt %.

* * * * *